US008313825B2

(12) United States Patent
Simmons et al.

(10) Patent No.: US 8,313,825 B2
(45) **Date of Patent: *Nov. 20, 2012**

(54) CURABLE RESIN FILMS

(75) Inventors: Martin Simmons, Cambridge (GB); John Leslie Cawse, West Wratting (GB); Ian Rees, Cottenham (GB); Xiuyan Sun, London (GB)

(73) Assignees: Hexcel Composites Limited, Duxford (GB); Conductive Inkjet Technology Limited, Ossett (GB)

( * ) Notice: Subject to any disclaimer, the term of this patent is extended or adjusted under 35 U.S.C. 154(b) by 33 days.

This patent is subject to a terminal disclaimer.

(21) Appl. No.: 12/440,488

(22) PCT Filed: Sep. 19, 2007

(86) PCT No.: PCT/GB2007/003551

§ 371 (c)(1),
(2), (4) Date: Mar. 9, 2009

(87) PCT Pub. No.: WO2008/040936

PCT Pub. Date: Apr. 10, 2008

(65) Prior Publication Data

US 2009/0317609 A1 Dec. 24, 2009

(30) Foreign Application Priority Data

Oct. 4, 2006 (GB) ..... 0619539.0

(51) Int. Cl.
*H05K 1/00* (2006.01)

(52) U.S. Cl. ..... 428/209; 428/297.4; 428/320.2; 174/257; 174/258; 174/259; 427/98.1

(58) Field of Classification Search ..... 428/209, 428/297.4, 320.2; 427/96, 961, 98.1; 174/257, 174/258, 259

See application file for complete search history.

(56) References Cited

U.S. PATENT DOCUMENTS

| | | | | |
|---|---|---|---|---|
| 3,900,320 | A * | 8/1975 | Rolker et al. | 430/324 |
| 5,447,996 | A * | 9/1995 | Asai et al. | 525/398 |
| 5,685,898 | A | 11/1997 | Dupuis | |
| 5,837,355 | A * | 11/1998 | Hayai | 428/209 |
| 5,965,245 | A * | 10/1999 | Okano et al. | 428/209 |
| 6,197,407 | B1 * | 3/2001 | Andou et al. | 428/209 |
| 6,245,696 | B1 * | 6/2001 | Haas et al. | 442/348 |
| 6,565,954 | B2 * | 5/2003 | Andou et al. | 428/209 |
| 6,846,549 | B2 * | 1/2005 | Tani et al. | 428/209 |
| 7,001,662 | B2 * | 2/2006 | Sugaya et al. | 428/344 |
| 7,045,198 | B2 * | 5/2006 | Nakagiri et al. | 428/209 |
| 2002/0154427 | A1 | 10/2002 | Takahagi | |
| 2005/0130397 | A1 | 6/2005 | Bentley et al. | |
| 2005/0153078 | A1 | 7/2005 | Bentley et al. | |

FOREIGN PATENT DOCUMENTS

| | | |
|---|---|---|
| EP | 0913498 | 5/1999 |
| EP | 1640153 | 3/2006 |
| JP | 62284082 | 12/1987 |
| WO | WO92/21790 | 12/1992 |
| WO | WO2004/068389 | 8/2004 |
| WO | WO2005/010108 | 2/2005 |
| WO | WO2005/045095 | 5/2005 |
| WO | WO2005/056875 | 6/2005 |
| WO | WO2006/084064 | 8/2006 |

* cited by examiner

*Primary Examiner* — Cathy Lam
(74) *Attorney, Agent, or Firm* — W. Mark Bielawski; David J. Oldenkamp

(57) ABSTRACT

A curable resin with at least one electrically conductive metal region on its surface formed by depositing on the surface a composition comprising activator, contacting the activator with a solution of a reducing agent and a solution of a metal ion, the reducing agent and metal ion undergoing chemical reaction activated by the activator to form an electrically conductive metal region on the surface, and method of forming is provided.

20 Claims, 2 Drawing Sheets

(a) (b)

CURABLE RESIN FILMS

TECHNICAL FIELD

The present invention relates to curable resin films with at least one conductive metal region, particularly when fibre-reinforced for use in forming structures.

BACKGROUND AND PRIOR ART

Composite materials, e.g. comprising an array of fibres impregnated with a cured resin, are widely used in the manufacture of light weight structures. However, such structures suffer from being vulnerable to electromagnetic hazards such as lightning strikes, causing damage to the structure, which is a particular problem for aircraft structures. Varying techniques and methods have been suggested in the prior art to provide lightning strike protection to composite materials, all involving the addition of conductive elements.

U.S. Pat. No. 4,429,341 discloses a method by which a graphite epoxy composite is layered with one or more layers of dielectric material applied over the exposed composite surface portion of an aircraft, the outermost layer of dielectric material (Kapton®—polyimide) having a binder on the exposed surface thereof for holding a finely divided (conductive) metal powder (e.g. aluminium) distributed uniformly over the surface of the outermost layer of dielectric material.

EP 0318839 discloses a method by which a wire grid (titanium, diameter 1.27 mm) is disposed intermediate two structural panels of a fibrous graphite material. A further conductive strip (titanium) is positioned around the periphery of the lightning protective skin member and electrically coupled to the wire members of the grid such that all the wire members are electrically coupled together. Titanium is the preferred metal as it prevents corrosion problems encountered when using other metals in contact with graphite.

WO 2004/033293 discloses a method to protect aircraft from lightning strikes by fabricating cheaper aircraft panel assemblies comprising a honeycomb core surrounded by a plurality of inner filler ply layers and a plurality of inner prepreg layers. At least one metal foil layer, more specifically an aluminium foil layer, is placed on the outer layer of the plurality of inner filler ply layers and inner prepreg layers.

US 2006/0078705 discloses a method for repairing fibre-reinforced composite structures while maintaining original EM and lightning protection using carbon nanotubes, fibres and thermoset resins. The electrical conductivity of the carbon fiber composite material is further modified with additional components, preferably carbon nanotubes, and more preferably carbon nanotubes replete with additional carbon-based materials (e.g. Buckyballs, fullerenes, carbon black), and other electrically conductive materials such as organic and inorganic metal compounds (e.g. indium tin oxides and zinc oxides).

EP 0629549 discloses an upper layer composition for "strengthening" an epoxy composite structure comprising a copper mesh. The upper layer comprises nickel-coated carbon (or Kevlar® aramid) fibres woven into a cloth. The coefficients of thermal expansion for copper (19 ppm/° C.) and the epoxy composite (1 ppm/° C.) are sufficiently different such that if not properly bonded, this difference causes microcracking of the epoxy surface, and corrosion of the copper mesh ensues. Layering the composite with an additional upper layer of woven electrically conductive nickel-coated carbon (or Kevlar® aramid) fibres, provides a suitably strengthened composite with enhanced lightning strike protection, with only a minor increase in weight (200 g/m$^2$).

US 2004/0084103 discloses a composite preform structural panel comprising electrically conductive (metallic thread) stitching, whereby the stitching forms an electrically conductive grid-like network to better dissipate electrical energy received in a lightning strike. Disclosed in the embodiments is a metallic thread with a preferred diameter in the range of 1.5 to 750 μm, more preferably 250 to 750 μm, most preferably 400 to 700 μm. Preferred metals include stainless steels, Nickel 200, Copper 11000, Titanium (CP), brass, Hastalloy X, Hastalloy C-22, NiChrome and aluminium.

EP 0913498 discloses a process of depositing metal onto solid polymer surfaces, e.g. printed circuit boards.

US 2002/0154427 discloses a process of applying a metallic mirror surface to solid substrates.

SUMMARY OF INVENTION

In a first aspect, the invention provides a curable resin film with at least one electrically conductive metal region on its surface formed by depositing on the surface a composition comprising activator, contacting the activator with a solution of a reducing agent and a solution of a metal ion, the reducing agent and metal ion undergoing chemical reaction activated by the activator to form an electrically conductive metal region on the surface.

In a second aspect, the invention provides a method of forming a curable resin film with at least one electrically conductive metal region on its surface, the method comprising depositing on a surface of a curable resin film an activator composition, followed by contacting the activator with a solution of a reducing agent and a solution of a metal ion, the reducing agent and metal ion undergoing chemical reaction activated by the activator to form an electrically conductive metal region on the surface.

A particular advantage of having a conductive metal region deposited onto the resin film is that it can impart electrical conductivity to any structure made up from the resins of the present invention. Electrical conductivity is useful for electromagnetic hazard management, such as lightning strike protection, EMI shielding and electrostatic dissipation.

Furthermore, in view of the way in which the metal region is formed (i.e. by forming the metal region in situ on the resin film), the resulting thicknesses can be very small, as compared to metal regions employed in known ways of introducing electrical conductivity to resin films, giving an associated reduction in weight. A reduction in weight has obvious advantages when the resin is to be used to form a vehicle body, particularly an aeroplane body.

Prior art methods of providing electrical conductivity to resin films typically involve handling a separate metallic structure which is brought into contact with the resin film. Because the metal region is associated with the resin, a further advantage of the present invention is that a separate metallic structure does not need to be handled, giving an improvement in handling and convenience.

The Resin Film

The curable resin is typically a non-solid reactive resin, and is preferably flowable, for example a viscous liquid. The resin may exhibit viscoelastic properties. Preferably, the resin film comprises a fibre reinforcement structure.

Fibre reinforcements may be selected from carbon, graphite, glass, silica, boron, basalt, polyamide, aramid, liquid crystal, polyester and polyolefin as well as natural fibres, but the preferred fibres are carbon, graphite, glass and aramid. Preferably the fibre-reinforced curable resin film is flexible, allowing it to take the shape of a solid surface it is applied to.

A preferred fibre-reinforced resin film takes the form of what is known as a 'prepreg', which can be used to form structures, such as aeroplane bodies. Prepregs are characterized by a structure consisting essentially of one layer of reinforcement containing sufficient resin at the surface to afford tack. Structures are generally formed from a plurality of uncured prepregs. Once a structure is formed in this way, the prepregs are cured to give the composite structure.

A still further advantage of the invention is that damaged structures made from cured resins of the present invention are more easily repaired than those made from prior art methods, in view of the fact that the metal regions are associated with the resin films. Thus no separate metal structure needs to be employed in any repair operation.

The resins of the present invention are curable in any method which is compatible with the activator. Generally this will be by thermal, electron beam, ultra-violet or infra-red techniques. Thermal curing is currently favoured. Curing of the resin takes place after the at least one metal region has been formed. Once cured the resins typically become solid.

The resin is preferably selected so that it can survive an aqueous treatment, e.g. by immersion in a bath.

Suitable curable resins may be selected from epoxies, bismaleimides, cyanate esters, vinyl esters, unsaturated polyesters, benzoxazines, phenolics and others well known in composite technology. Where epoxy resins are used, the curing agents used are preferably those with limited water solubility. Such curing agents include aromatic multifunction amines for example methylenedianiline and its derivatives, and diaminodiphenylsulfones. Dicyandiamide, a commonly used epoxy curative, has substantially water solubility of 3% at 20° C. and is not preferred.

Other components of the resin film may include toughening agents, for example reactive liquid rubbers, particulate thermoplastics, and soluble or partially soluble thermoplastics, fire retardants, dyes and pigments, plasticizers and flexibilizers, inorganic fillers, thixotropes and tackifiers.

The activator composition is typically applied directly onto the resin surface, however optionally the resin surface may be treated with a lacquer to give a smoother surface finish to the resin.

A wetting control agent may also be applied to the surface of the resin film prior to deposition of the activator composition. The wetting control agent functions to control wetting by modifying surface energy and also functions to keep the subsequently applied activator composition stably spread, e.g. prior to curing, preventing de-wetting and reticulation. Suitable wetting control agents include polymers such as polyvinylpyrrolidone (PVP), polyacrylic acid, polyvinyl acetate, polyethylene imine, polyethylene oxide, polyethylene glycol, gelatin and polymers thereof. The wetting control agent may be applied in any convenient manner, e.g. by inkjet printing. The wetting control agent is suitably applied in the form of a thin film, typically less than 1 micron thick, e.g. about 100 nm thick. The wetting control agent functions to create more uniform surface energy on different surfaces, e.g. substrate, adhesive, component surface, leading to deposited material forming tracks of more uniform width and thickness than would otherwise be the case.

Usually only one surface of the resin will be treated with the activator composition, however in some cases it may be advantageous to treat both resin film surfaces. When it is desired to treat only one surface, typically the opposing surface has a backing paper to improve handling.

The present invention is also believed to provide reduced corrosion problems as compared to prior art methods, which are encountered in prior art lightning strike resistant prepregs, particularly carbon fibre reinforced prepregs. Such corrosion arises as a result of physical contact between the metallic mesh structure and the fibre reinforcement. The small thickness of the metal region results in a reduced chance of such a contact being formed and the metal region is observed to remain on the resin surface, out of contact with the fibre reinforcement inside the resin.

In the case when the reinforcing fibres are electrically conducting (e.g. carbon fibres) it is nevertheless preferred that a layer of non-conducting fibres separate the conducting fibres from the metal region, in order to reduce such corrosion problems still further.

Activator Composition

The activator composition desirably comprises one or more curable materials.

The curable material(s) can undergo a chemical change resulting in hardening, preferably solidification. The hardening process improves adhesion of the material to the resin and results in formation of a solid region on the resin that may be rigid, plastic, elastic, resilient, gelatinous, permeable or have any other property consistent with being in the solid phase, as opposed to liquid or gas. The solid region may include regions in liquid or gaseous form.

The curable material(s) are such that the resulting solid region adheres to the resin, and so may be selected having regard to the resin properties. Adhesion can arise through chemical bonding, physical bonding, mechanical bonding or a mixture thereof.

The activator composition is brought into contact with the resin surface while the composition is in liquid form, and is subsequently caused or allowed to cure. Curing typically takes place while the activator composition is still in liquid form, although the activator composition may instead be converted to solid form, e.g. by drying, prior to curing of the activator.

The activator itself is typically incorporated in the resulting solid region, whether by entrapment, immobilization or other means, and is typically dispersed throughout the solid region within a matrix formed by the cured composition. The activator is thus adhered with respect to the resin by virtue of its inclusion in the region.

The curable material(s) typically comprise one or more monomers and/or oligomers which can polymerize or cross-link in use, thereby hardening and forming a solid region on the resin. Suitable monomers and/or oligomers are those known from the field of UV curable, or other curable inks proposed for inkjet printing of curable inks. Preferably, the resulting product forms a matrix, typically a polymer matrix, which includes the activator. Suitable monomers and/or oligomers have a high number of cross-linkable functional groups, such as four or more, or even six of more functional groups. For example, Actilane 505 (which is a reactive tetrafunctional polyester acrylate oligomer supplied by Akzo Nobel UV Resins, Manchester, UK) is suitable, as is DPHA (dipentaerythritol hexacrylate), which is a hexafunctional monomer supplied by UCB, Dragenbos, Belgium. These monomers and/or oligomers with a high number of cross-linkable functional groups are more highly cross-linked than polymers formed from monomers with fewer cross-linkable functional groups and can provide a stronger, more flexible film with better adhesion to the resin. Too high a proportion of highly cross-linkable monomers and/or oligomers would however form a brittle surface.

The curable material(s) are curable in response to appropriate curing conditions. For example, the activator composition may be curable in response to a stimulus, such as electromagnetic radiation of a particular wavelength band (e.g. ultra-violet, blue, microwaves, infra-red), electron beams, or heat. The material(s) could instead be curable in response to appropriate chemical conditions, particularly the presence of a chemical curing agent or hardener. As a further possibility the material(s) may be curable in response to the presence of species such as moisture or air. Preferably, the curable material(s) are selected to undergo a reaction responsive to one or more of the above stimuli. UV-curable materials are currently preferred.

The resin must remain in a curable condition following curing of the activator composition. As would be evident to a person skilled in the art, the curing condition must therefore be selected so that curing of the resin does not occur.

The activator composition optionally includes surfactant in small amount (say up to 1% by weight) to improve wetting. Suitable surfactants can be selected having regard to the substrate on which the composition is to be printed. Suitable surfactants include the following:

| Commercial name | Chemical name | Supplier |
|---|---|---|
| BYK 333 | Polyether modified poly-dimethyl-siloxane | BYK Chemie GmbH |
| BYK 381 | Ionic solution of polyacrylic copolymer | BYK Chemie GmbH |
| Dynol 604 | Non-ionic acetylenic glycol-based surfactant | Air Products |
| Surfadone LP 100 | N-alkyl pyrrolidone | ISP |

The activator composition typically includes a suitable initiator appropriate to the curable materials, e.g. a thermal initiator, photoinitiator etc. Suitable initiators are well known to those skilled in the art, as are suitable levels of use (typically less than about 5% by weight). Examples of photoinitiators include Irgacure 2959, Irgacure 127, 184, 651, 1800, 819 (Ciba), Darocure 1173 etc. (Irgacure and Darocure are Trade Marks). Examples of thermal initiators include VA 044 (2,2'-azobis[2-(2-imidazolin-2-yl)propane]dihydrochloride), VA 057 (2,2'-azobis[N-(2-carboxyethyl)-2-methylpropionamidine]) from Wako Chemicals.

The activator typically comprises a catalyst or catalyst precursor, and is conveniently a salt or complex of a conductive metal, preferably a salt of a transition metal, particularly palladium, platinum or silver. The salt may be inorganic, such as palladium chloride, or organic, such as palladium acetate or palladium propanoate.

One preferred activator is palladium acetate, which is a catalyst precursor. Palladium acetate is a precursor of palladium, which is a catalyst in metallization reactions. Palladium acetate may be converted to an active or catalytic form by reduction in situ in the activator-containing region on the substrate, e.g. by subsequent application of a reducing agent, conveniently an aqueous solution of dimethylamine borane (DMAB) to form palladium metal. The resulting palladium metal can catalyze deposition of metal thereon on appropriate subsequent treatment, to be discussed below.

The activator is suitably present in the activator composition in an amount in the range 1 to 3% by weight of the composition.

The palladium acetate is typically present in the activator composition in an amount in the range 0.5 to 3%, preferably 0.8 to 1.2% by weight.

Alternative activators include other palladium salts, complexes or colloids; salts, complexes or colloids of other transition metals; and metal particles such as particles of bronze, aluminium, gold or copper.

A mixture of activators may be used.

Preferably the activator composition is primarily or entirely non-aqueous.

Deposition of Activator Composition

The activator composition may coat most or all of the entire resin surface. Alternatively, and preferably, the activator composition may be formed on the resin according to a pattern. This may be achieved in several ways. For example, the activator composition may be deposited according to a pattern, e.g. by printing in the desired pattern, particularly by inkjet printing, which is preferred. Alternatively, the activator composition may be patterned after the activator composition has been deposited; for example, the activator composition may be applied extensively across the surface, selectively cured according to a pattern and uncured activator composition may then be removed. Selective curing according to a pattern can be achieved by use of a mask, such as a shadow mask for liquid or solid layers or a contact mask for solid layers, to limit exposure to a stimulus as discussed above, e.g. UV radiation. Laser writing (using a laser of appropriate wavelength for a particular initiator) and electron beam writing can also be used. With electron beam writing, a photoinitiator is not required, and this approach can be used to create patterns with very fine features, of the order of 10 nm. As a further possibility, when using chemical curing, a curing agent or hardener may be selectively applied according to a desired pattern. In all cases, excess (uncured) material may be removed by techniques including washing, spraying or immersion in suitable reagents such as an acid or alkali, or by physical means such as use of an air knife.

Thus, the use of a curable activator composition can allow patterning to an extent which would not be possible were the activator deposited on the substrate as a liquid which remained soft and flowed.

The activator composition can be applied extensively to the resin surface by a wide range of possible techniques, including using printing, dipping, spraying and spinning techniques such as jet printing, inkjet printing, spin coating, dip coating, spray coating, aerosol spraying, roller coating, curtain coating, screen printing, litho printing, flexo printing, gravure printing and pad printing, or by any other liquid application technique.

Preferably, the activator composition is brought into contact with the surface by a deposition process, for example a printing process. Preferably, the deposition process is a non-contact process that is preferably digital e.g. inkjet printing. The activator is preferably applied as a single liquid, e.g. by inkjet printing from a single liquid reservoir.

Printing processes typically result in production of an activator layer having a thickness greater than 300 nm and possibly significantly thicker.

Thus, in use, the activator composition is applied to a surface of the substrate typically by drop-on-demand inkjet printing. In this respect, unlike conventional printing techniques, the activator composition can be applied to the substrate surface in a non-contact manner, thereby retaining the integrity of the resin. Moreover, since the activator composition is applied in a digitally controlled manner, patterns with a grid-like appearance can be achieved without formation of cross-over points with an uneven finish, as would be afforded by continuous inkjet printing. Cross-over points can inhibit dissipation of electrical energy encountered during a lightning strike producing localized heating/melting at the intersections of the gridlines.

The curable materials in the activator composition are generally caused or allowed to cure, e.g. by exposure to UV, prior to application of the solution of reducing agent and metal ion (second fluid), so that the activator-containing region is in solid condition.

A drying step may also be required, e.g. using exposure to microwaves. For UV-curable materials we have found it can be beneficial to precede curing with a brief drying step, e.g. by exposure to an infra-red source, as this has been found to produce films with improved wet-fastness and durability.

The process of activator deposition and subsequent reduction and deposition of metal ion may be carried out in a batchwise or continuous manner, as desired.

Metal Deposition

A conductive metal layer is typically formed by the reduction of metal ions in a reaction involving the activator (catalyst), a metal ion and a reducing agent. A variety of different techniques may be used, including electroless deposition and the process disclosed in WO 2004/0683989. The activator may be deposited on the resin surface by inkjet printing, and other necessary reagents deposited (by inkjet printing, immersion or otherwise) in one or more further liquids, preferably aqueous liquids, resulting in reaction to form a conductive metal layer on the substrate. Further details of suitable techniques are given in WO 2004/068389, WO 2005/045095, WO 2005/056875 and WO 2005/010108.

Immersion processes are generally favoured, for reasons of reliability, simplicity and efficiency.

The metal ion may be an ion of any conductive metal, particularly a transition group metal. Preferable conductive metals include copper, nickel, silver, gold, cobalt, a platinum group metal, or an alloy or two or more of these materials. The conductive metal may include non-metallic elements, for example, the conductive metal may be nickel-phosphorus.

The metal ion is typically in the form of a salt, for example copper sulphate. The metal ion might instead be present in a complex such as with EDTA (ethylenediaminetetraacetic acid) or cyanide.

Examples of appropriate reducing agents are formaldehyde, most other aldehydes, glucose, sodium hypophosphites, glyoxylic acid and DMAB (dimethylamine borane).

Preferably, the components of the activator composition are selected so that the deposited activator composition is permeable to the metal ion when it is brought into contact with the deposited activator composition, as disclosed in International Application WO 2005/045095. We have found that this can substantially improve the effective activation/catalytic activity of the deposited activator composition. In particular, the metal ion can penetrate the deposited activator composition, allowing the metal ion to access the activator. The metal forming reaction can thus take place on, or in close proximity to, the resin surface, producing the desired metal layer on the resin. Furthermore, penetration of the metal ion into the deposited activator composition may result in the metal layer intermingling with the deposited activator composition, thereby enhancing adhesion of the metal layer to the resin via the adhered deposited activator composition and improving through layer conductivity (where the second layer is conductive from its top surface down to the surface of the resin).

The Metal Tracks

The resulting conductive metal region is exceptionally thin in the direction perpendicular to the thickness of the resin film. Thus the curable resin films of the present invention have lightning protection at a greatly reduced weight. Additionally, the surface of the resins generally remains tacky after formation of the metal region, so that, when used as prepregs, they are able to be used in the formation of a structure.

Furthermore, when used as prepregs, the drapability and flexibility is not adversely affected, so they can be used to form structures conveniently and efficiently.

Thus, in a third aspect, the present invention provides a curable resin film with at least one electrically conductive metal region on its surface having a thickness, in the direction perpendicular to a surface of the resin film, of less than 20 microns.

The invention provides much thinner conductive tracks than any known in the prior art. A very fine metal mesh suitable for lightning strike protection would consist of 50 micron diameter copper or bronze wires or thickness of aluminium film. This reduction in thickness gives a significant saving in weight, without compromising electrical conductivity.

The metal tracks of the present invention may have a thickness of less than 10 microns, less than 5 microns, less that 2 microns, or even less than 1 micron. Metal tracks with even smaller thicknesses have been found acceptable. Thus metal tracks with a thickness of less than 0.5 microns or even less than 0.2 microns have been found acceptable.

Essentially any pattern of metal tracks can be deposited, and is only limited by the method of deposition of the activator composition. Using a printing method can ensure that a high density of parallel metal tracks can be deposited without the possibility of entanglement or cross-over, which is encountered when a fine wire mesh is involved, as used in the prior art.

PREFERRED EMBODIMENTS

In one preferred embodiment, an activator composition including one or more UV-curable materials and palladium acetate is deposited on a substrate by piezoelectric inkjet printing. After curing by exposure to UV, the substrate is immersed in a bath of weak aqueous solution of DMAB under suitable conditions to reduce the palladium acetate to palladium (e.g. 10 to 20 seconds at room temperature (about 25° C.)). After washing, the substrate is immersed in a bath containing a copper plating solution (e.g. Enplate 827 solutions from Cookson Electronic Materials) (Enplate is a Trade Mark) under suitable conditions to form conductive metal regions on the deposited palladium (e.g. 1 minute at 45° C.).

The invention will be further described, by way of illustration, in the following examples, with reference to the following illustrations and figures, in which.

EXAMPLE 1

Figure 1:
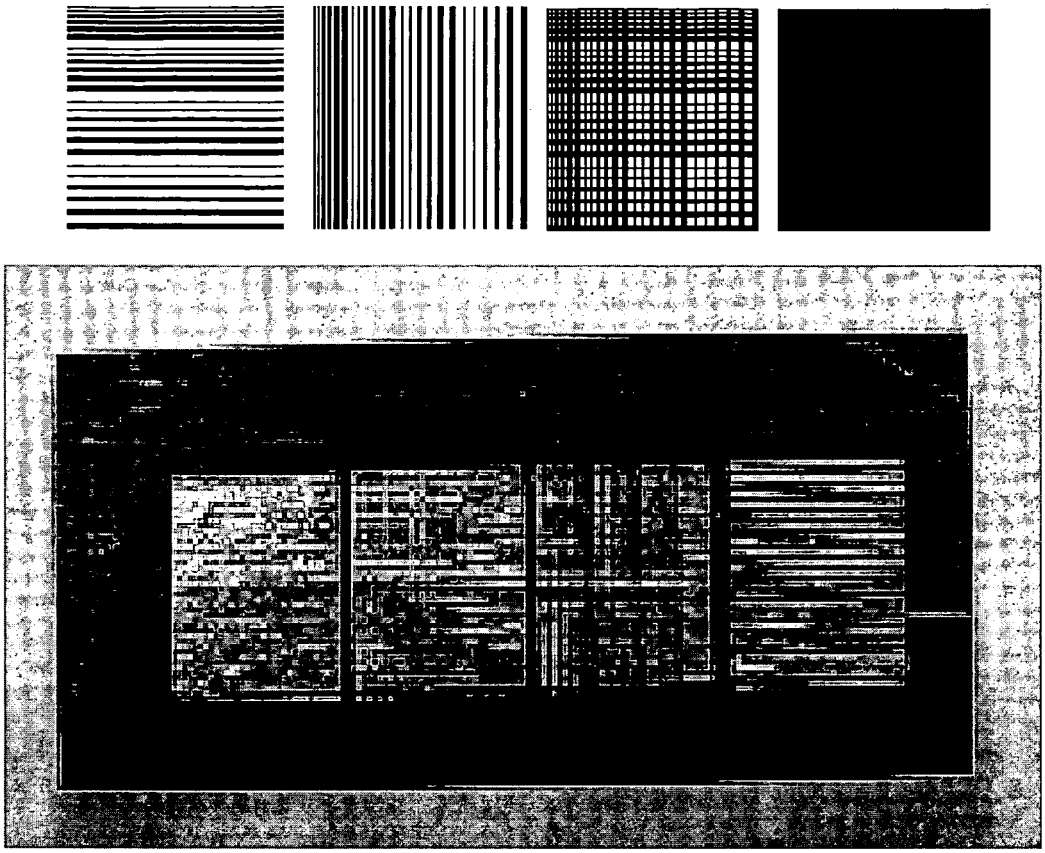
FIG. 1 shows diagrammatically four patterns of metal tracks, with images of the resulting metal tracking when printed onto a resin in accordance with the invention.

A commercially available curable resin film prepreg (HexPly M36, Hexcel Corporation) was obtained. The prepreg comprised 35 wt % resin and 65 wt % AS7 carbon fibre.

The prepreg was smoothed between siliconised paper, using a warm iron to produce a flat surface for subsequent printing. On immersion in water for 20 minutes at room temperature, a weight increase of only 0.12% was observed demonstrating that this prepreg has a very low water absorption in the uncured state.

Printing was carried out as follows:

A typical palladium activator ink (available from Conductive Inkjet Technologies Limited, UK) termed ALF126b as shown below in Table 1, was inkjet printed with a XJ500/180 print head (available from Xaar of Cambridge, UK) with a print speed of 0.9 m/s at 180×250 dpi.

TABLE 1

| | ALF 126b |
|---|---|
| Palladium acetate | 2 |
| Irgacure 127 | 3.25 |
| Irgacure 819 | 1.25 |
| DPGDA | 48 |
| DPHA | 3 |
| Actilane 505 | 10 |
| Diacetone alcohol | 15 |
| Methoxy propanol | 15 |
| PVP K30 | 2.5 |
| Viscosity, cPs (25° C.) | 11.2 |

(Figures are percentages by weight)

PVP K30 is a grade of polyvinyl pyrrolidinone supplied by ISP, Tadworth, UK. Actilane 505 is a reactive tetrafunctional polyester acrylate oligomer supplied by Akzo Nobel UV Resins, Manchester, UK. DPHA is dipentaerythritol hexacrylate, a hexafunctional monomer, supplied by UCB, Dragenbos, Belgium. Irgacure 819 and Irgacure 127 are UV photo-initiators supplied by Ciba Specialty Chemicals, Macclesfield, UK—Irgacure is a Trade Mark. DPGDA is dipropylene glycol diacrylate, a reactive diluent monomer supplied by UCB, Drogenbos, Belgium.

Twelve print passes were utilized and the printhead was offset 10 microns between each print pass. The XJ500/180 print head ejects droplets of 80 pL. Once printed, the samples were then cured to a solid film using a Fusion (Fusion is a Trade Mark) UV 500 W H-bulb, in 12 passes of 20 meters/min each, resulting in the formation of the activator layer. The activator film was then treated with a reductant by immersion in a bath comprising 1.6% dimethylamine borane (DMAB) at 45° C. for 1 minute (no stirring) to reduce the palladium ions to palladium metal and generate a catalyst for the copper deposition reaction.

The printed catalyst was first rinsed with deionized water and then immersed in a copper layer forming solution (45° C., no stirring, 30 s to 2 minutes) consisting of Enplate Cu-872 A (30% w/w), Enplate Cu-872 B (30% w/w) and Enplate Cu-872 C (10% w/w), available from Enthone Ltd. of Woking, UK. Enplate is a Trade Mark). Enplate Cu-872 A contains copper sulphate. Enplate Cu-872B contains Quadrol as a complexing agent and formaldehyde. Enplate Cu-872 C contains sodium hydroxide and potassium cyanide. Enplate Cu-872 A, Cu-872 B and Cu-872 C are in common use as component solutions for electroless copper plating. This treatment is applied by immersion in a bath process. The solution is applied for 2 minutes to form copper tracks corresponding to the pattern in which the activator had been inkjet printed. Conductive copper layers of 300 nm and greater have been demonstrated depending on the specific chemistry used. Repeat printing can be used to build up thicker layers, such as 10 to 15 micron layers, as required.

FIG. 1 shows the pattern used to investigate the line width and line separation and the copper sample of the pattern. Four groups of line separation pattern were used. Each line group contains four lines with line thickness 1, 2, 3 and 4 pixels respectively. The line separations are 1 pixel for the first group, 2 pixels for the second group, 3 pixels for the third group and 4 pixels for the fourth group respectively. As it can be seen that with line width of 3 pixels and line separation of 2 mm, the lines are well distinguished from each other.

Figure 2:
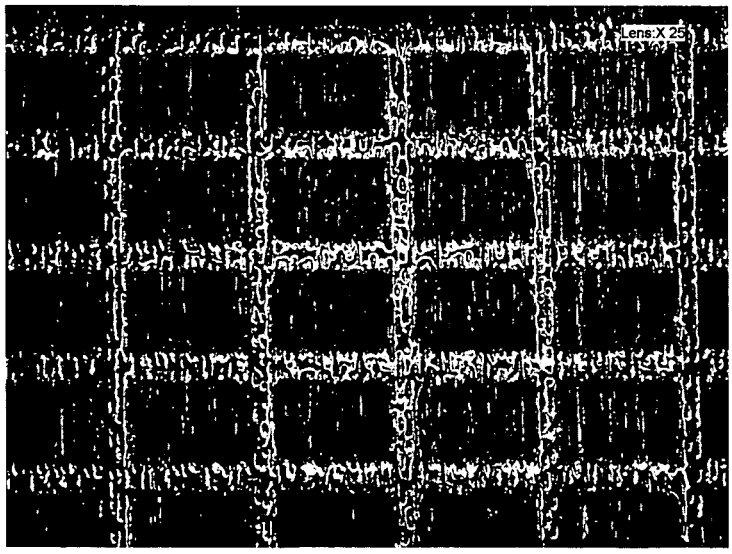
FIG. 2 shows a micrograph of a resin printed with a rectangle pattern of conductive metal tracks before curing.

The resulting pattern was as shown in the micrograph in FIG. 2.

Before cure a dynamic differential scanning calorimetry (from 0° C. to 350° C. at a ramp rate of 10° C./min) was carried out on the printed prepreg and compared to the unmodified prepreg to determine if reactivity and onset temperatures changed.

| Sample | Onset (° C.) | Peak (° C.) | Enthalpy ($Jg^{-1}$) |
|---|---|---|---|
| Prepreg | 217.1 | 258.4 | 152 |
| Prepreg + copper | 192.3 | 238.5 | 123 |

The DSC demonstrated that reactivity parameters still display acceptable values after the prepreg had been exposed to the printing and deposition process.

Figure 3:
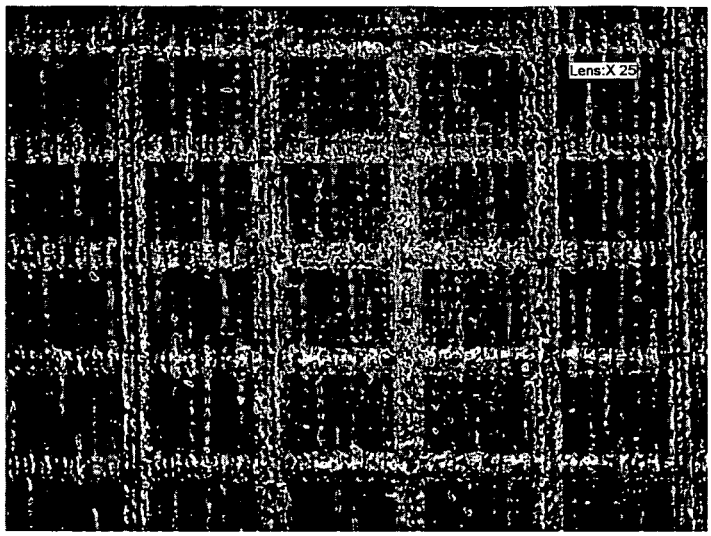
FIG. 3 shows a micrograph of the printed resin shown in FIG. 2 following curing.

The printed prepreg was laid up unidirectionally, as the top ply together with 3 further plies of the same prepreg without printing, and cured on a vacuum table at a pressure of 7 bar at 177° C. for 2 hours. A micrograph of the resulting cured prepreg is shown in FIG. 3. It can clearly be seen that the metal tracks have not been damaged by the prepreg curing process.

The glass transition temperature of the cured prepreg was determined by dynamic DMA (5° C./minute ramp rate) to be 207° C. compared to 210° C. for a non-printed material. This demonstrates that there has been only a very minor effect on the chemical composition of the prepreg on being exposed to the above printing and deposition process.

A resistance (measured from corner to corner of a 16×12 mm grid) of no less than 6Ω was found prior to curing. The electrical resistance post-cure was also less than 6Ω.

Figure 4:
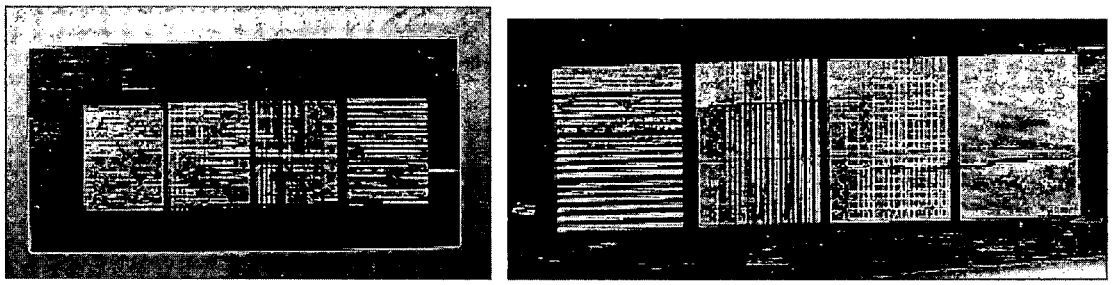
FIG. 4 shows the images of the printed resin of FIG. 1 together with images produced by the same method but where the resin was first treated with a lacquer.

In order to obtain still better coating quality, a thin layer of lacquer was coated on prepregs to modify the smoothness of the surface. The catalyst-containing ink was then printed and this dual layer structure was then metallized. Two examples with and without the surface lacquer are shown in FIG. 4. It can be seen that the lacquered prepregs improved the printing quality and copper deposition quality.

EXAMPLE 2

A commercially available curable resin film prepreg (HexPly 8552, Hexcel Corporation) was obtained. The prepreg comprised 35 wt % resin and 65 wt % carbon fibre.

The prepreg was smoothed between siliconized paper, using a warm iron to produce a flat surface for subsequent printing.

Printing was carried out as described in example 1.

Figure 5:
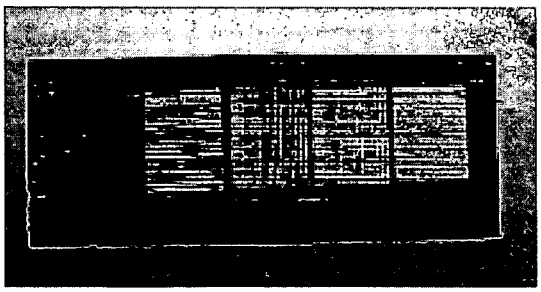
FIG. 5 shows images of printed curable resin in accordance with the invention.

The resulting pattern was as shown in FIG. 5

The printed prepreg was cured on a vacuum table at a pressure of 7 bar at 180° C. for 2 hours.

| Sample | Onset (° C.) | Peak (° C.) | Enthalpy ($Jg^{-1}$) |
|---|---|---|---|
| 8552 Prepreg | 181.7 | 228.7 | 170 |
| 8552 Prepreg + copper | 174.3 | 219.3 | 200 |

The DSC demonstrated that reactivity parameters still display acceptable values after the prepreg had been exposed to the printing and deposition process.

The glass transition temperature of the metallized cured prepreg was determined by DMA to be 207° C. compared to 212° C. for a non-printed cured prepreg.

The invention claimed is:

1. A curable resin composition comprising:

an uncured resin film that comprises a viscous liquid reactive resin, said uncured resin film comprising a surface that is tacky;

separated solid regions that are located on the surface of said uncured resin film to form an electrically conductive pattern, said separated solid regions comprising a cured polymer matrix in which an activator and metal are included, said metal having been formed from a chemical reaction between ions of said metal and a reducing agent, said chemical reaction having been activated by said activator.

2. The curable resin composition according to claim 1 wherein the uncured resin film comprises a fibre reinforcement.

3. The curable resin composition according to claim 2 wherein the uncured resin film is in the form of a prepreg.

4. The curable resin composition according to claim 2 wherein said fibre reinforcement structure comprises fibres selected from the group consisting of carbon fibres, graphite fibres, glass fibres and aramid fibres.

5. The curable resin composition according to claim 2 wherein said viscous liquid reactive resin comprises an epoxy resin and a curing agent for said epoxy resin.

6. The curable resin composition according to claim 2 wherein said curable resin composition is shaped for use in forming an aeroplane body.

7. The curable resin composition according to claim 2 wherein said fibre reinforcement structure comprises a layer of non-conducting fibres and a layer of conducting fibres wherein said layer of non-conducting fibres is located between said layer of conducting fibres and the surface of said resin film.

8. The curable resin composition according to claim 7 wherein said layer of conducting fibres comprises carbon fibres.

9. The curable resin composition according to claim 1 wherein said metal is a transition group metal.

10. The curable resin composition according to claim 1 wherein said viscous liquid reactive resin is selected from the group consisting of epoxies, bismaleimides, cyanate esters, vinyl esters, unsaturated polyesters, benzoxazines and phenolics.

11. The curable resin composition according to claim 10 wherein said activator comprises palladium.

12. The curable resin composition according to claim 1 wherein said cured polymer matrix comprises polyester acrylate.

13. The curable resin composition according to claim 1 wherein said electrically conductive pattern is in the form of a plurality of parallel lines.

14. The curable resin composition according to claim 1 wherein said electrically conductive pattern is in the form of a grid of intersecting lines.

15. The curable resin composition according to claim 1 wherein said solid regions are in the form of a plurality of solid lines wherein said solid lines have a thickness in a direction perpendicular to the surface of said uncured film, wherein the thickness of said solid lines is less than 20 microns.

16. The curable resin composition according to claim 1 wherein said metal is selected from the group consisting of copper, nickel, silver, gold, cobalt, platinum and alloys thereof.

17. The curable resin composition according to claim 1 wherein said viscous liquid reactive resin comprises an epoxy resin and a curing agent for said epoxy resin.

18. The curable resin composition according to claim 1 wherein said viscous liquid reactive resin comprises particulate thermoplastics.

19. The curable resin composition according to claim 18 wherein said viscous liquid reactive resin comprises soluble or partially soluble thermoplastics.

20. The curable resin composition according to claim 1 wherein said viscous liquid reactive resin comprises soluble or partially soluble thermoplastics.

* * * * *